US012259139B2

(12) United States Patent
Shinohara

(10) Patent No.: US 12,259,139 B2
(45) Date of Patent: Mar. 25, 2025

(54) HEATING COOKING APPARATUS

(71) Applicant: SHARP KABUSHIKI KAISHA, Sakai (JP)

(72) Inventor: Yu Shinohara, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 459 days.

(21) Appl. No.: 17/631,380

(22) PCT Filed: Aug. 3, 2020

(86) PCT No.: PCT/JP2020/029691
§ 371 (c)(1),
(2) Date: Jan. 28, 2022

(87) PCT Pub. No.: WO2021/024989
PCT Pub. Date: Feb. 11, 2021

(65) Prior Publication Data

US 2022/0325898 A1 Oct. 13, 2022

(30) Foreign Application Priority Data

Aug. 7, 2019 (JP) ..... 2019-145383

(51) Int. Cl.
*F24C 15/02* (2006.01)
*F24C 15/16* (2006.01)

(52) U.S. Cl.
CPC ..... *F24C 15/022* (2013.01); *F24C 15/162* (2013.01)

(58) Field of Classification Search
CPC ..... F24C 15/022; F24C 15/162; F24C 7/02; F24C 7/062; F24C 15/08; F24C 15/168; H05B 6/6414; H05B 6/6417
(Continued)

(56) References Cited

U.S. PATENT DOCUMENTS 3,715,552 A * 2/1973 Umezu ..... H05B 6/6417 219/722
3,715,554 A * 2/1973 Umezu ..... H05B 6/6417 219/722
(Continued)

FOREIGN PATENT DOCUMENTS

EP 2090833 A1 8/2009
JP S58-035707 A 3/1983
(Continued)

*Primary Examiner* — Allen R. B. Schult
*Assistant Examiner* — William C Weinert
(74) *Attorney, Agent, or Firm* — ScienBiziP, P.C.

(57) ABSTRACT

A heating cooking apparatus (100) includes a housing (1), a lid portion (21), a moving member (25), at least two connecting members (60), and a pivoting mechanism (30). The housing (1) includes an opening and a first face disposed on an outer periphery of the opening. The lid portion (21) includes a second face (21B) facing the first face, and a fixing member (26) fixed to the second face (2B). The moving member (25) moves along a first direction (D1) with respect to the housing (1). At least two connecting members (60) connect the housing (1) and the lid portion (21) when the lid portion (21) is placed at a position where the lid portion (21) covers the opening. The pivoting mechanism (30) couples the fixing member (26) of the lid portion (21) and the moving member (25) such that the lid portion (21) pivots about a rotation axis extending along a second direction intersecting with the first direction (D1).

4 Claims, 12 Drawing Sheets

(58) Field of Classification Search
USPC ..... 126/197
See application file for complete search history.

(56) References Cited

U.S. PATENT DOCUMENTS

| | | | | |
|---|---|---|---|---|
| 3,854,021 | A * | 12/1974 | Moore | H05B 6/766 219/734 |
| 4,149,518 | A * | 4/1979 | Schmidt | F24C 15/162 126/41 D |
| 4,335,292 | A | 6/1982 | Tanaka et al. | |
| 4,530,073 | A | 7/1985 | Higashihara et al. | |
| 8,101,889 | B2 | 1/2012 | Uno | |
| 8,253,084 | B2 | 8/2012 | Toyoda et al. | |
| 2009/0007608 | A1* | 1/2009 | Lorek | F25D 23/028 70/144 |
| 2010/0072187 | A1 | 3/2010 | Uno | |
| 2010/0133263 | A1 | 6/2010 | Toyoda et al. | |
| 2012/0187115 | A1 | 7/2012 | Toyoda et al. | |
| 2012/0192725 | A1 | 8/2012 | Toyoda et al. | |

FOREIGN PATENT DOCUMENTS

| | | | |
|---|---|---|---|
| JP | 61-66025 | A | 4/1986 |
| JP | H02309135 | A | 12/1990 |
| JP | 2010071585 | A | 4/2010 |
| JP | 2010133634 | A | 6/2010 |
| JP | 2011075247 | A | 4/2011 |
| JP | 2011163657 | A | 8/2011 |

* cited by examiner (a)

(b)

(a)

(b)

HEATING COOKING APPARATUS

TECHNICAL FIELD

The present invention relates to a heating cooking apparatus.

BACKGROUND ART

Patent Literature (PTL) 1 discloses a drawer type heating cooking apparatus. The drawer type heating cooking apparatus disclosed in PTL 1 includes a heating cooking apparatus main body and a drawer body. The heating cooking apparatus main body includes a heating cooking chamber.

The drawer body can be drawn toward the outside of the heating cooking apparatus main body from a state where the drawer body is accommodated in the heating cooking chamber. The drawer body includes a lid portion. With the drawer body retracted into the heating cooking chamber, a sealer surface at the rear side of the lid portion closes an opening at the front side of the heating cooking chamber.

CITATION LIST

Patent Literature

PTL 1: JP 2010-133634 A

SUMMARY OF INVENTION

Technical Problem

A second face such as the sealer surface of the lid portion is held in close contact with or at a predetermined interval (for example, 0.5 mm) with a first face disposed on the outer periphery of the opening. Then, in recent years, there has been a demand to accurately retain the degree of parallelism between the second face at the rear side of the lid portion and the first face at the front side of a housing such as the heating cooking chamber with the drawer body retracted into the heating cooking chamber.

In consideration of the above-described problem, an object of the present invention is to provide a heating cooking apparatus that can accurately retain the degree of parallelism between the second face of the lid portion and the first face of the housing.

Solution to Problem

A heating cooking apparatus according to the present invention includes a housing, a lid portion, a moving member, at least two connecting members, and a pivoting mechanism. The housing includes an opening and a first face disposed on an outer periphery of the opening. The lid portion includes a second face facing the first face, and a fixing member fixed to the second face. The moving member moves along a first direction with respect to the housing. The at least two connecting members connect the housing and the lid portion when the lid portion is placed at a position where the lid portion covers the opening. The pivoting mechanism couples the fixing member of the lid portion and the moving member such that the lid portion pivots about a rotation axis extending along a second direction intersecting with the first direction.

Advantageous Effects of Invention

The heating cooking apparatus according to the present invention can retain with high accuracy the degree of parallelism between the second face of the lid portion and the first face of the housing.

DESCRIPTION OF EMBODIMENTS

Figure 1:
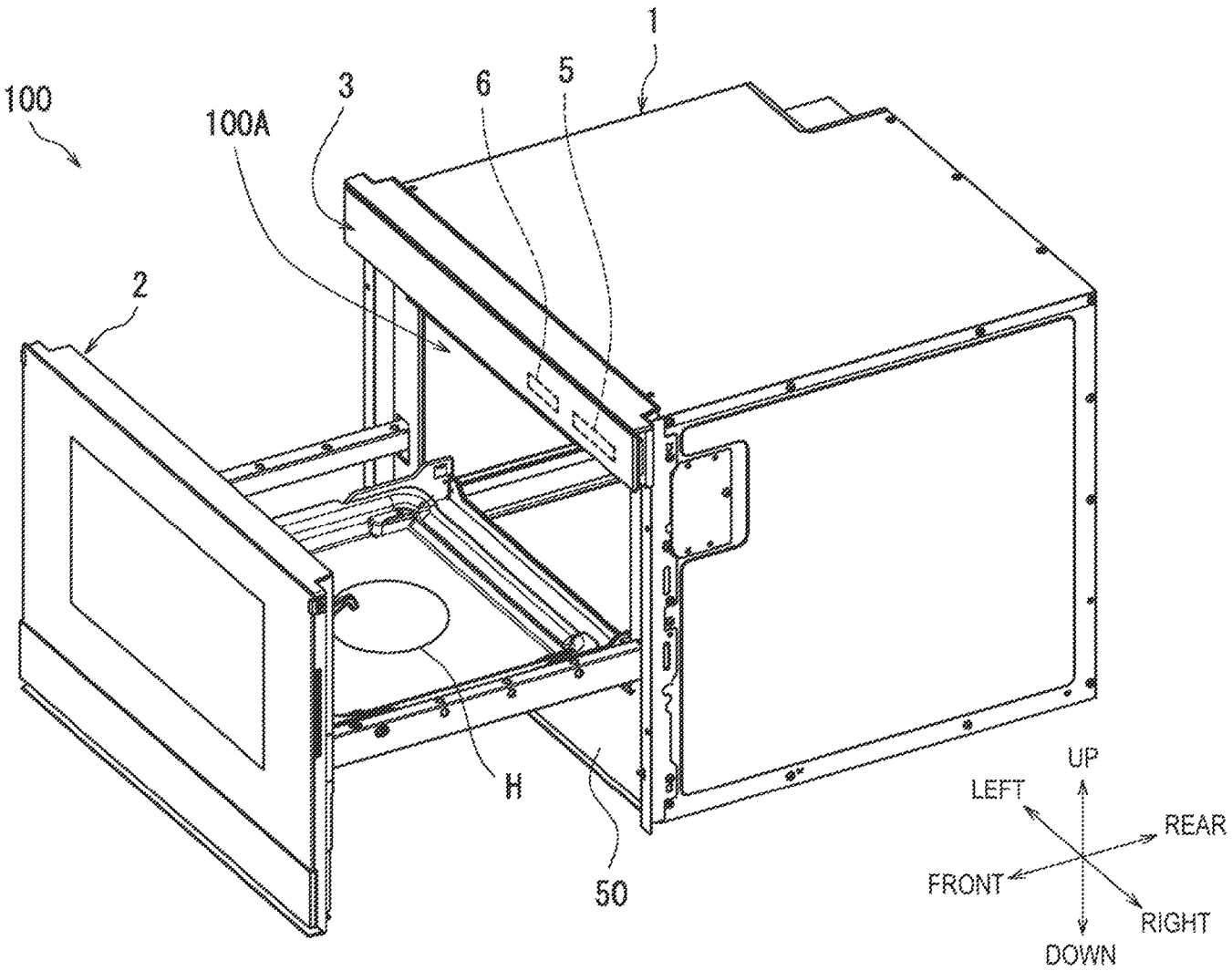
FIG. 1 is a perspective view illustrating an appearance of a drawer type heating cooking apparatus according to an embodiment of the present invention.

Hereinafter, an embodiment of a drawer type heating cooking apparatus according to the present invention will be described with reference to the drawings. In the drawings, the same or equivalent components are denoted by the same reference signs and descriptions thereof will not be repeated.

Figure 2:
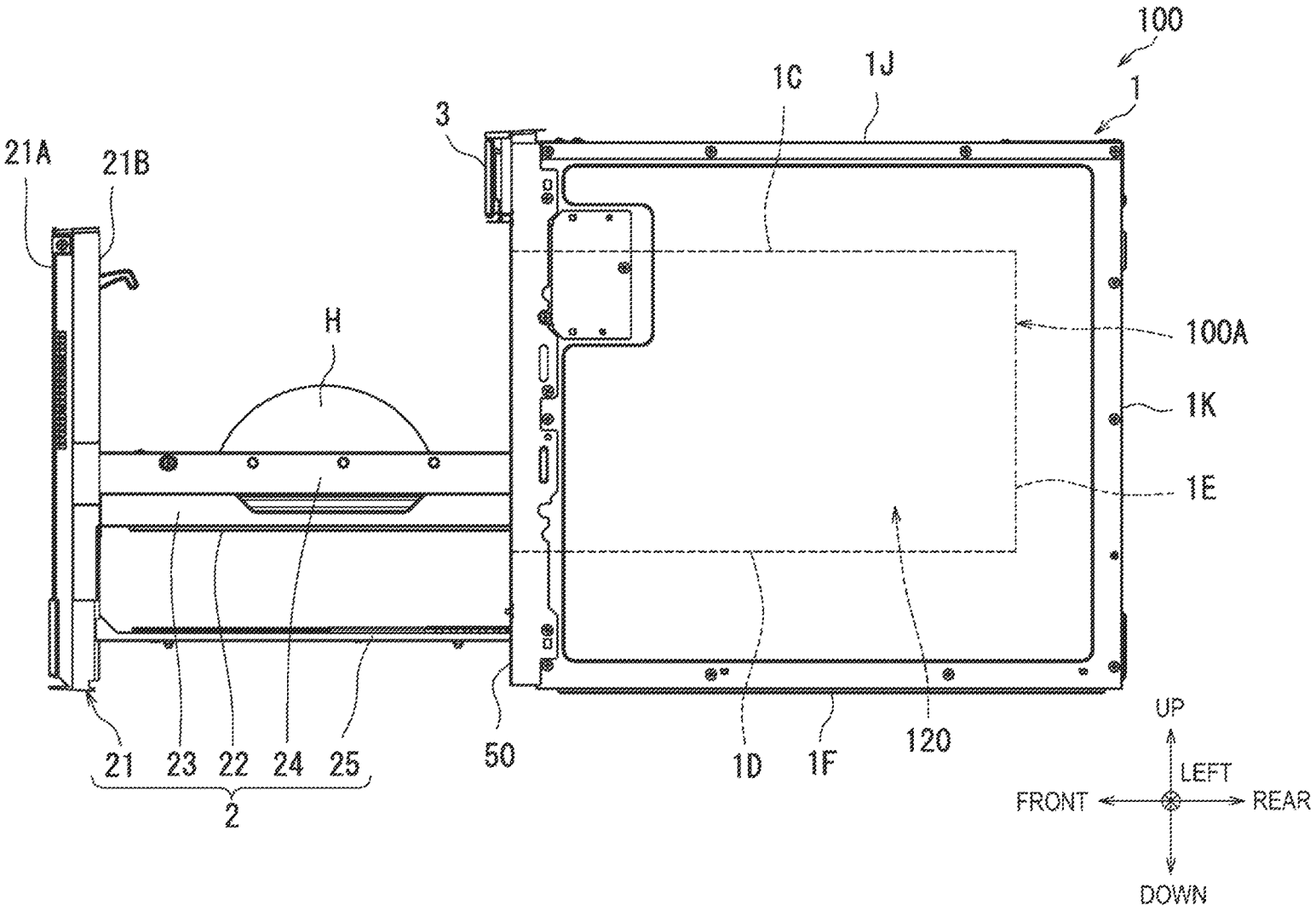
FIG. 2 is a right side view illustrating the drawer type heating cooking apparatus according to the present embodiment.
Figure 3:
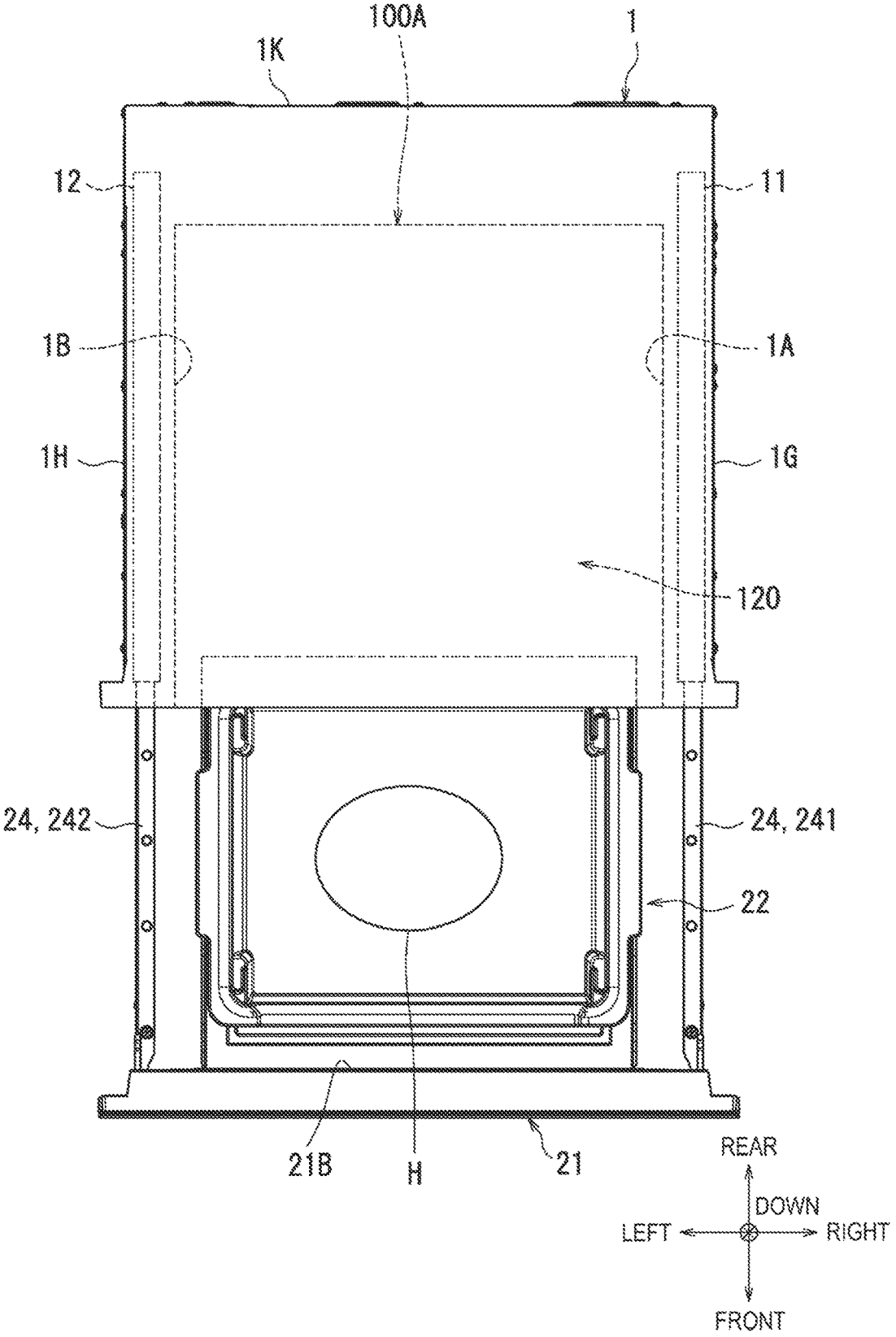
FIG. 3 is a top view illustrating the drawer type heating cooking apparatus according to the present embodiment.

A drawer type heating cooking apparatus 100 according to the present embodiment will be described with reference to FIG. 1 to FIG. 3. FIG. 1 is a perspective view illustrating an appearance of the drawer type heating cooking apparatus 100 according to the present embodiment. FIG. 2 is a right side view illustrating the drawer type heating cooking apparatus 100 according to the present embodiment. FIG. 3 is a top view illustrating the drawer type heating cooking apparatus 100 according to the present embodiment. More specifically, FIG. 1 to FIG. 3 illustrate the drawer type heating cooking apparatus 100 in a state where a drawer body 2 is pulled out. Further, FIG. 1 illustrates the appearance of the drawer type heating cooking apparatus 100 viewed from the above obliquely from the front right. The drawer type heating cooking apparatus 100 is one example of a heating cooking apparatus.

The drawer type heating cooking apparatus 100 heats and cooks an object to be heated H. The object to be heated H is, for example, a food product. As illustrated in FIG. 1, the drawer type heating cooking apparatus 100 includes a heating chamber 1, a drawer body 2, an operation panel 3, a panel 50, a control unit 5, and a storage unit 6. The heating chamber 1 is an example of a housing.

In the present embodiment, a side at which the operation panel 3 of the drawer type heating cooking apparatus 100 is disposed is defined as a front side of the drawer type heating cooking apparatus 100, and a side opposite to the front side is defined as a rear side of the drawer type heating cooking apparatus 100. Further, a right side of the drawer type heating cooking apparatus 100 when the drawer type heating cooking apparatus 100 is viewed from the front side is defined as a right side, and a side opposite to the right side is defined as a left side of the drawer type heating cooking apparatus 100. Further, in a direction orthogonal to a front-rear direction and a left-right direction of the drawer type heating cooking apparatus 100, a side at which the operation panel 3 is disposed is defined as an upper side of the drawer type heating cooking apparatus 100, and a side opposite to the upper side is defined as a lower side of the drawer type heating cooking apparatus 100. Note that these orientations do not limit the orientation of the drawer type heating cooking apparatus according to the present invention when it is in use.

As illustrated in FIG. 1 to FIG. 3, the heating chamber 1 is a box-like member. Specifically, the heating chamber 1 includes a right outer wall 1G, a left outer wall 1H, a top outer wall 1J, a bottom outer wall 1F, and a back outer wall 1K. The heating chamber 1 also includes a heating cooking chamber 100A therein.

The heating cooking chamber 100A includes an accommodation space 120 that accommodates the object to be heated H. The accommodation space 120 has a predetermined capacity as a space that can accommodate the object to be heated H. The heating cooking chamber 100A further includes a right wall 1A, a left wall 1B, a top wall 1C, a bottom wall 1D, and a back wall 1E. The shape of the heating cooking chamber 100A is, for example, a substantially rectangular parallelepiped shape. Materials of the right wall 1A, the left wall 1B, the top wall 1C, the bottom wall 1D, and the back wall 1E are, for example, metal.

The heating chamber 1 further includes a space between the bottom wall 1D and the bottom outer wall 1F. The heating chamber 1 further includes a space between the right wall 1A and the right outer wall 1G. The heating chamber 1 further includes a space between the left wall 1B and the left outer wall 1H. The heating chamber 1 further includes a space between the top wall 1C and the top outer wall 1J. The heating chamber 1 further includes a space between the back wall 1E and the back outer wall 1K.

The operation panel 3 includes an operation unit and a display portion. The operation unit receives an operation from a user. The operation unit includes various types of keys. The display portion displays various pieces of information. The display portion includes a liquid crystal panel. The operation panel 3 is located on an upper portion of a front face of the heating chamber 1.

The storage unit 6 includes a Random Access Memory (RAM) and a Read Only Memory (ROM). The storage unit 6 stores control programs used for controlling operations of each part of the drawer type heating cooking apparatus 100. The storage unit 6 stores setting information input when the operation panel 3 is operated.

The control unit 5 is a hardware circuit that includes a processor such as a Central Processing Unit (CPU). The control unit 5 executes a control program stored in the storage unit 6.

Figure 4:
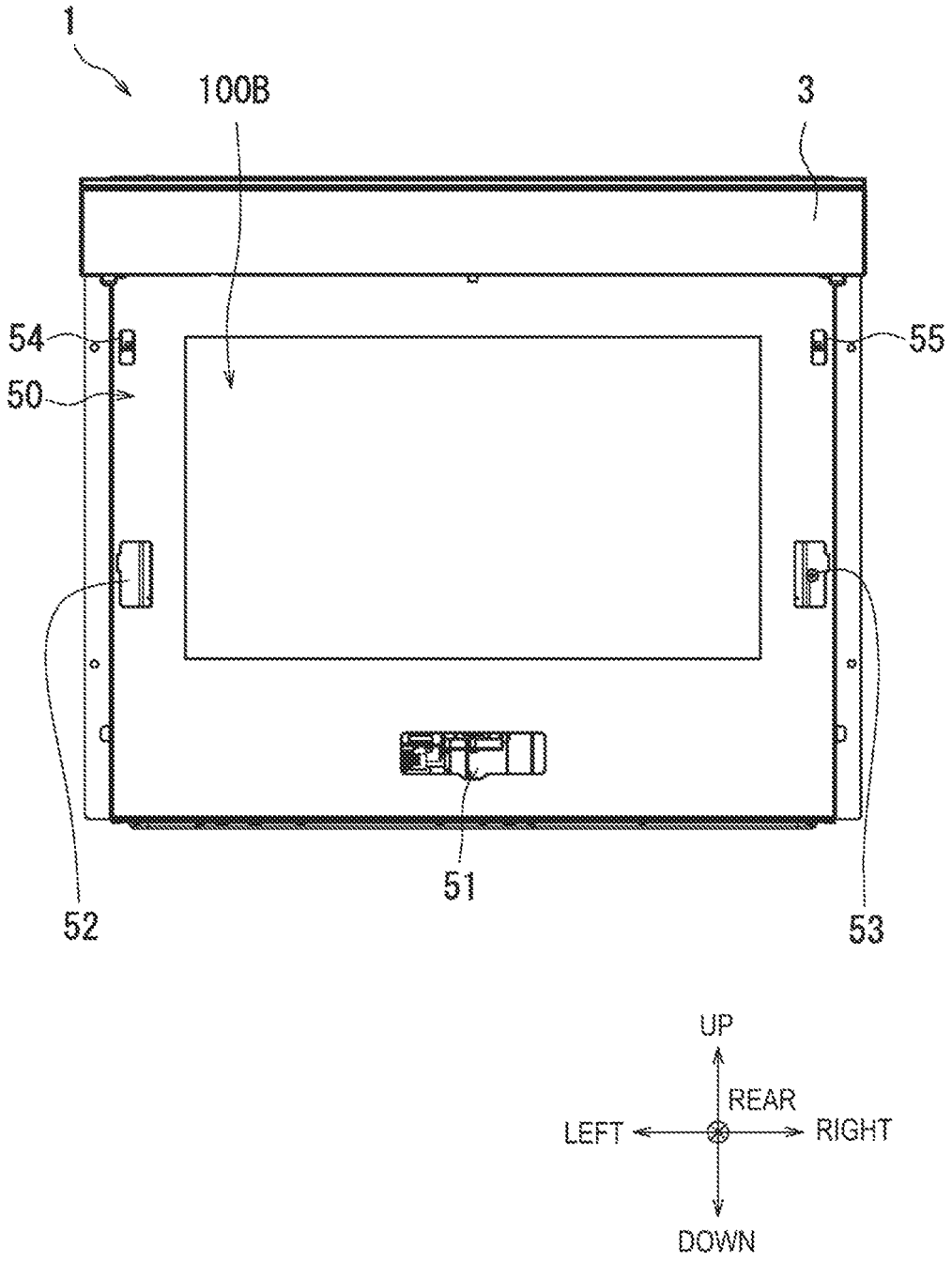
FIG. 4 is a front view of the drawer type heating cooking apparatus according to the present embodiment.

Additionally, the front side of the heating cooking chamber 100A is opened to allow the object to be heated H to be inserted and removed. An opening for inserting and removing the object to be heated H will be described with reference to FIG. 4. FIG. 4 is a front view of the drawer type heating cooking apparatus 100 according to the present embodiment. In detail, FIG. 4 is a front view illustrating the drawer type heating cooking apparatus 100 according to the present embodiment in a state where the drawer body 2 is detached.

As illustrated in FIG. 1 to FIG. 4, the heating chamber 1 further has an opening 100B on the front side. The panel 50 is an example of a first face. The opening 100B is rectangular. The opening 100B and the heating cooking chamber 100A communicate with each other. The panel 50 is disposed around the outer periphery of the opening 100B. Specifically, the panel 50 is a plate-like member having a rectangular ring shape. The panel 50 includes a first through hole 51, a second through hole 52, a third through hole 53, a fourth through hole 54, and a fifth through hole 55.

The first through hole 51, the second through hole 52, the third through hole 53, the fourth through hole 54, and the fifth through hole 55 are formed around the opening 100B. Specifically, the first through hole 51 is formed at a position at the lower side of the opening 100B. The second through hole 52 is formed at a position at the left side of the opening 100B. The third through hole 53 is formed at a position at the right side of the opening 100B. The fourth through hole 54 is formed at a position at the left side of the opening 100B and at the upper side of the second through hole 52. The fifth through hole 55 is formed at a position at the right side of the opening 100B and at the upper side of the third through hole 53.

Next, the drawer body 2 will be described with reference to FIG. 1 to FIG. 4. The drawer body 2 can be pulled out of and pushed into the heating chamber 1. Specifically, the drawer body 2 includes a lid portion 21, a placement portion 22, and a support portion 23.

The lid portion 21 is a substantially rectangular plate-like member. Specifically, the lid portion 21 includes a glass plate having a rectangular shape, a metal plate positioned on the outer periphery of the glass plate, and a metal comb portion positioned on the outer periphery of the metal plate. The metal comb portion has, for example, a choke structure, and suppresses leakage of microwaves. The lid portion 21 includes a front face 21A and a rear face 21B. The rear face 21B is an example of the second face.

The lid portion 21 can open and close the opening 100B on the front side of the heating cooking chamber 100A. Specifically, the lid portion 21 moves between a closed position and an open position. The open position indicates a position where the lid portion 21 opens the opening 100B. On the other hand, the closed position indicates a position where the lid portion 21 covers the opening 100B.

The lid portion 21 closes the opening 100B on the front side of the heating cooking chamber 100A in a state where the drawer body 2 is retracted into the heating cooking chamber 100A. Specifically, the closed position indicates a position where the panel 50 and the rear face 21B face each other. More particularly, the closed position indicates a position where a distance between the panel 50 and the rear face 21B is a predetermined distance or where the panel 50 and the rear face 21B come into contact with each other. The predetermined distance is, for example, 0.5 mm. The position where the panel 50 and the rear face 21B come into contact with each other is, for example, a position where the panel 50 and the rear face 21B come into close contact with each other. Meanwhile, in a state where the drawer body 2 is retracted into the heating cooking chamber 100A, a distance between the top wall 1C and the bottom wall 1D is shorter than a distance between the back wall 1E and the rear face 21B.

The object to be heated H can be placed on the placement portion 22. The placement portion 22 is, for example, a plate-like member made of ceramic or glass. The support portion 23 is fixed to the rear face 21B of the lid portion 21, and supports a peripheral portion of the placement portion 22 such that the placement portion 22 is held in a horizontal state. A material of the support portion 23 includes metal. The placement portion 22 and the support portion 23 are pulled out from the inside of the heating cooking chamber 100A to the outside by pulling out the drawer body 2. The placement portion 22 and the support portion 23 are accommodated in the heating cooking chamber 100A in a state where the drawer body 2 is retracted.

Figure 5:
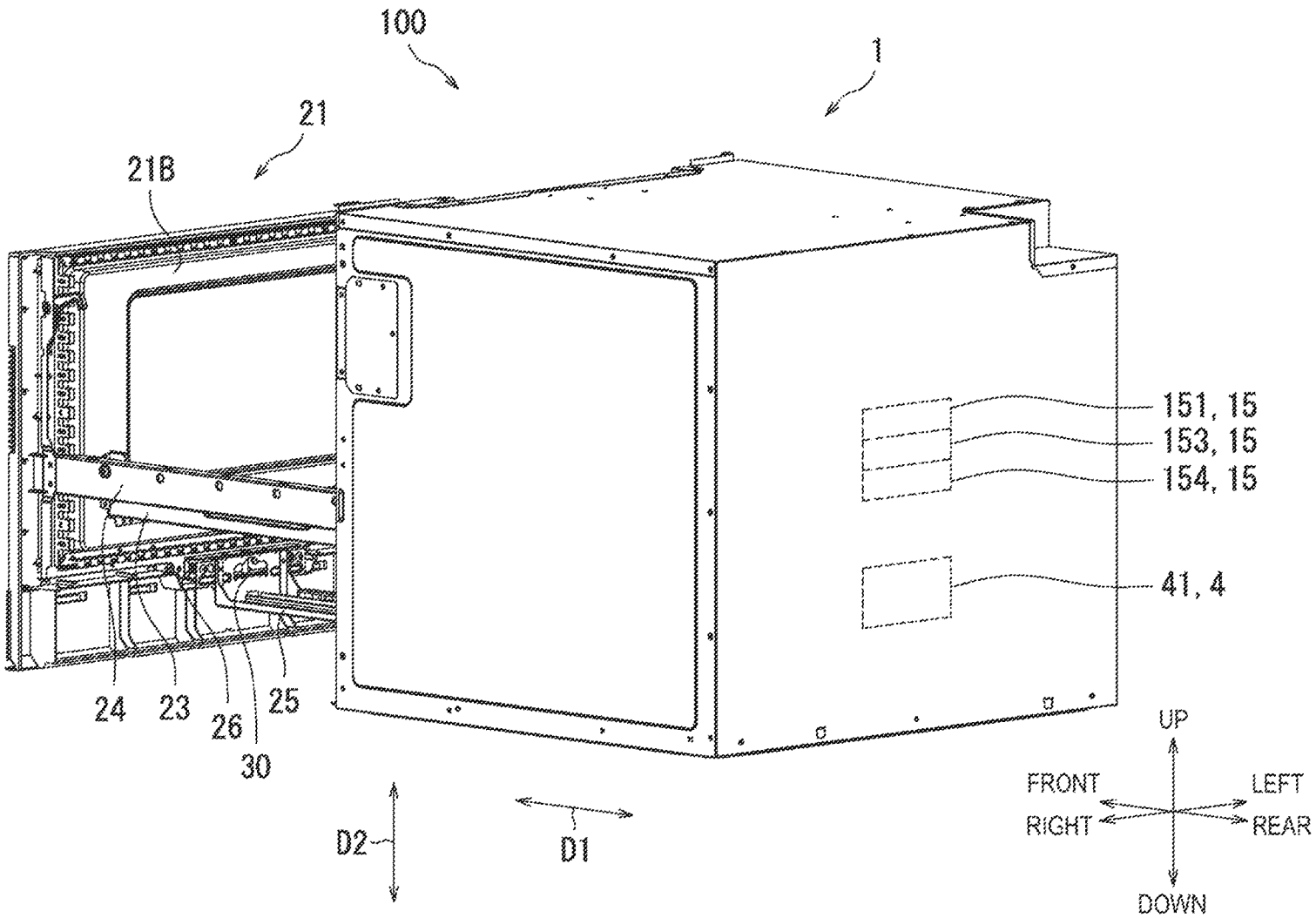
FIG. 5 is a perspective view illustrating an appearance of the drawer type heating cooking apparatus according to the present embodiment.

Next, a drive mechanism of the drawer body 2 will be described in detail. FIG. 5 is a perspective view illustrating an appearance of the drawer type heating cooking apparatus 100 according to the present embodiment. For further details, FIG. 5 illustrates the appearance of the drawer type heating cooking apparatus 100 viewed from the above obliquely from the rear right. As illustrated in FIG. 1 to FIG. 5, the drawer body 2 further includes a pair of slide members 24 and a support member 25 in addition to the lid portion 21, the support portion 23, and the placement portion 22. The support member 25 is an example of a moving member.

The lid portion 21 further includes a fixing member 26. The fixing member 26 is fixed to the rear face 21B. Specifically, the fixing member 26 is attached at a center portion in the left-right direction of the rear face 21B of the lid portion 21 and at the lower side of the placement portion 22. The fixing member 26 has a plate-like member protruding in the rear direction.

The support member 25 moves along a first direction D1 with respect to the heating chamber 1. The first direction D1 is along the front-rear direction. The support member 25 is a member having the front-rear direction as a longitudinal direction. The fixing member 26 of the lid portion 21 is attached to one end portion of the support member 25. The other end portion of the support member 25 is provided with a rack portion. The rack portion includes a plurality of teeth.

Meanwhile, the heating chamber 1 further includes a drive mechanism 4. The drive mechanism 4 is accommodated in a space between the bottom wall 1D and the bottom outer wall 1F. For example, the drive mechanism 4 includes a drive motor 41, and a pinion. The pinion is attached to a tip end portion of the drive motor 41. The drive motor 41 rotates the pinion.

The support member 25 is inserted into the first through hole 51. The pinion engages with the rack portion of the support member 25. Furthermore, the support member 25 moves in the front-rear direction when the pinion rotates. As a result, the lid portion 21 moves between the closed position and the open position.

Further, as illustrated in FIG. 1 to FIG. 5, the pair of slide members 24 regulate the movement direction of the drawer body 2 in the front-rear direction. The pair of slide members 24 are fixed to the rear face 21B of the lid portion 21. Specifically, the pair of slide members 24 include a right slide member 241 and a left slide member 242. Each of the right slide member 241 and the left slide member 242 is a member having the front-rear direction as a longitudinal direction. The right slide member 241 and the left slide member 242 oppose each other in the left-right direction. One end portion of the right slide member 241 is attached to a right edge portion of the rear face 21B of the lid portion 21. One end portion of the left slide member 242 is attached to a left edge portion of the rear face 21B of the lid portion 21.

Meanwhile, the heating chamber 1 further includes a right slide rail 11 and a left slide rail 12. The right slide rail 11 is fixed in a space between the right wall 1A and the right outer wall 1G. The left slide rail 12 is fixed in a space between the left wall 1B and the left outer wall 1H. Each of the right slide rail 11 and the left slide rail 12 is a member having the front-rear direction as a longitudinal direction.

The right slide member 241 is inserted into the third through hole 53. The right slide member 241 is supported to be slidable along the right slide rail 11. The left slide member 242 is inserted into the second through hole 52. The left slide member 242 is supported to be slidable along the left slide rail 12.

The drawer type heating cooking apparatus 100 further includes a microwave supply unit 15. The microwave supply unit 15 supplies microwaves into the heating cooking chamber 100A. Specifically, the microwave supply unit 15 includes a radiation chamber, a magnetron 151, a waveguide, a rotary antenna 153, and an antenna motor 154. The magnetron 151 generates microwaves. The waveguide propagates the microwaves generated by the magnetron 151 to the radiation chamber. The rotary antenna 153 is accommodated in the radiation chamber. The antenna motor 154 drives the rotary antenna 153. The rotary antenna 153 agitates microwaves and supplies the microwaves into the heating cooking chamber 100A.

Figure 6:
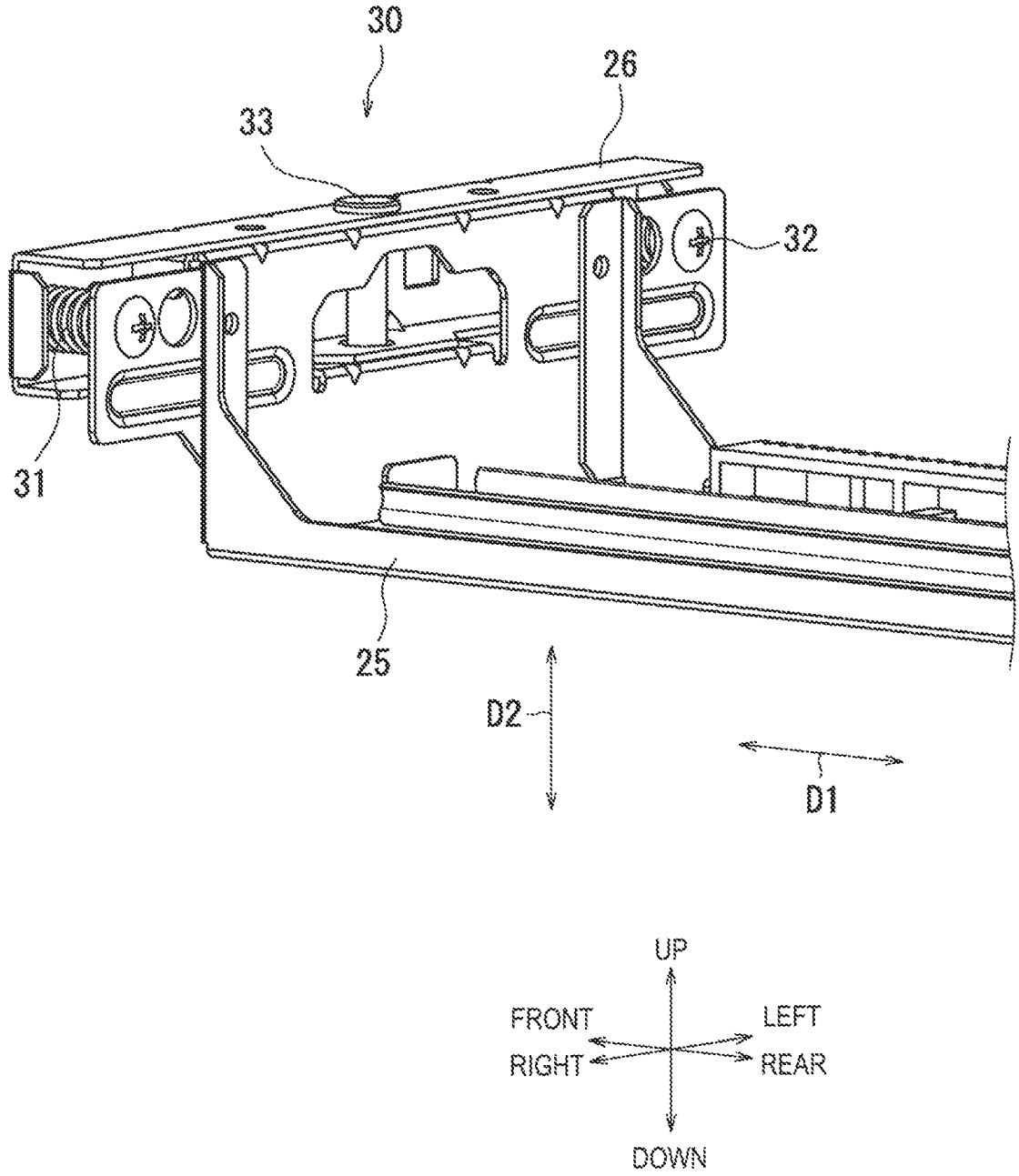
FIG. 6 is a perspective view illustrating an appearance of a part of a drawer body according to the present embodiment.

Next, the drawer body 2 will be described in detail. FIG. 6 is a perspective view illustrating an appearance of a part of the drawer body 2 according to the present embodiment. As illustrated in FIG. 5 and FIG. 6, the drawer type heating cooking apparatus 100 further includes a pivoting mechanism 30.

The pivoting mechanism 30 couples the fixing member 26 and the support member 25 of the lid portion 21. In particular, the pivoting mechanism 30 couples the fixing member 26 of the lid portion 21 and the support member 25 such that the lid portion 21 pivots about a rotation axis extending along a second direction D2. The second direction D2 intersects with the first direction D1. In particular, the second direction D2 is orthogonal to the first direction D1.

As described above, when the degree of parallelism between the rear face 21B at the rear side of the lid portion 21 and the panel 50 at the front side of the heating chamber 1 is lost, the lid portion 21 can pivot, so the degree of parallelism between the rear face 21B at the rear side of the lid portion 21 and the panel 50 at the front side of the heating chamber 1 can be retained with high accuracy.

Specifically, the pivoting mechanism 30 includes a rotation axis portion 33, a first elastic body 31, and a second elastic body 32.

The first elastic body 31 acts along the first direction D1 between the rear face 21B and the support member 25. The first elastic body 31 is, for example, a coil spring. In particular, the coil spring is arranged along the first direction D1. One end portion of the coil spring comes into contact with the rear face 21B. The other end portion of the coil spring comes into contact with a plate-like body at the front side of the support member 25.

The second elastic body 32 acts along the first direction D1 between the rear face 21B and the support member 25. The second elastic body 32 is also a coil spring, for example. In particular, the coil spring is arranged along the first direction D1. One end portion of the coil spring comes into contact with the rear face 21B. The other end portion of the coil spring comes into contact with a plate-like body at the front side of the support member 25.

The rotation axis portion 33 has, for example, a cylinder, a head, and a tip end portion. The cylinder extends along the second direction D2. The head is positioned at the upper side of the cylinder. The tip end portion is positioned at the lower side of the cylinder. Then, the cylinder passes through a through hole of the fixing member 26 and a through hole of the support member 25 along the second direction D2. As a result, the fixing member 26 is pivotable with respect to the support member 25 about the rotation axis portion 33.

Then, when viewed from the second direction, the rotation axis portion 33 is positioned between the first elastic body 31 and the second elastic body 32. As a result, due to the action of the first elastic body 31 and the second elastic body 32, it is possible to suppress an excessive rotation of the fixing member 26 about the rotation axis portion 33.

Figure 7:
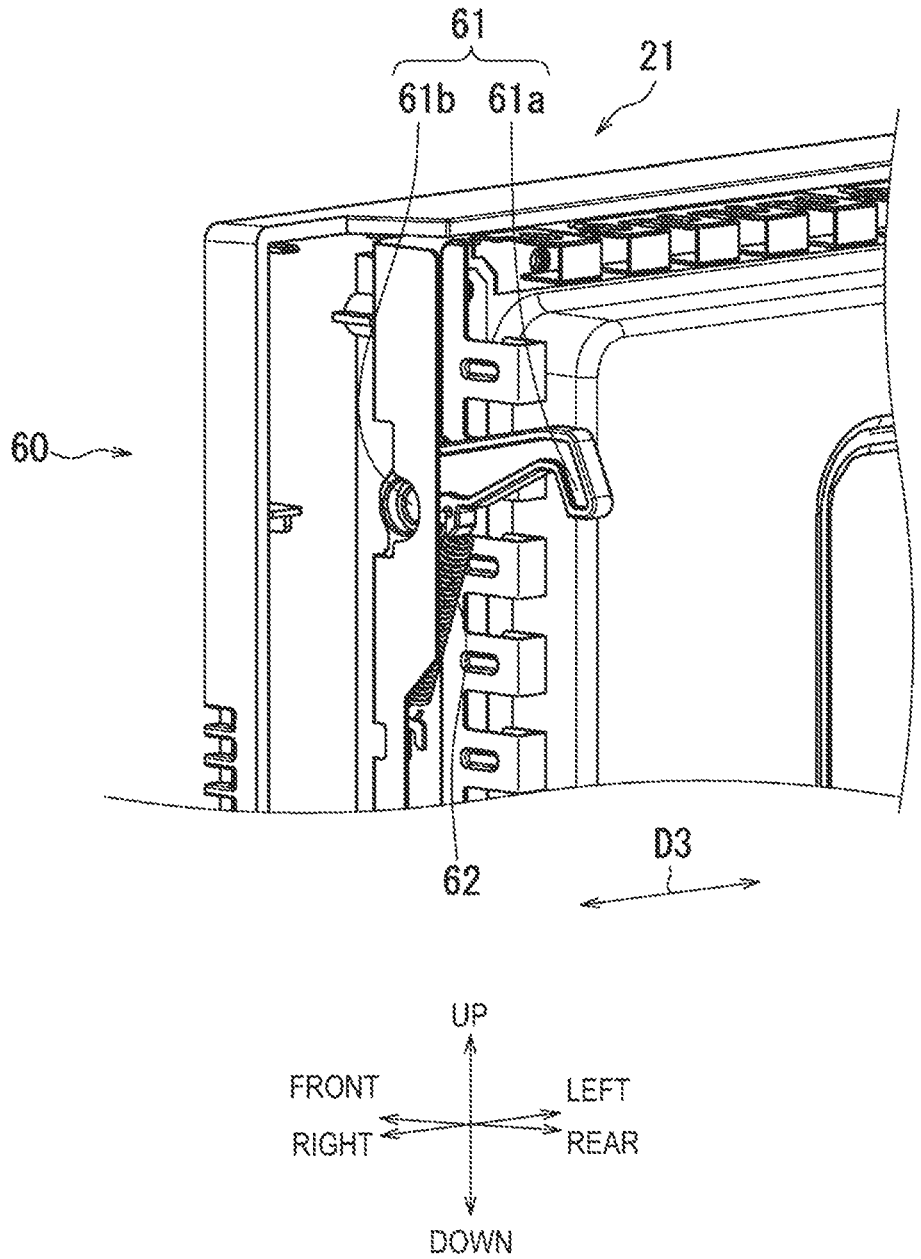
FIG. 7 is a perspective view illustrating an appearance of a part of the drawer body according to the present embodiment.

Next, the drawer body 2 will be described in detail. FIG. 7 is a perspective view illustrating an appearance of a part of the drawer body 2 according to the present embodiment. As illustrated in FIG. 5 and FIG. 7, the drawer type heating cooking apparatus 100 further includes at least two connecting members 60.

The at least two connecting members 60 connect the heating chamber 1 and the lid portion 21 when the lid portion 21 is at the closed position. The at least two connecting members 60 include a first connecting member and a second connecting member, for example.

The first connecting member and the second connecting member are attached to the lid portion 21. The first connecting member and the second connecting member oppose each other in the left-right direction. The first connecting member is attached at an edge portion at the right side of the rear face 21B of the lid portion 21 and at the upper side of the placement portion 22. In addition, the second connecting member is attached at an edge portion at the left side of the rear face 21B of the lid portion 21 and at the upper side of the placement portion 22.

Specifically, each of the at least two connecting members 60 includes a hook member 61 and an elastic member 62.

The hook member 61 is a plate-like member having its longitudinal direction as the front-rear direction. The hook member 61 includes a claw portion 61*a* and a rotation pin portion 61*b*. The rotation pin portion 61*b* is positioned at one end portion of the hook member 61. The rotation pin portion 61*b* pivots about a rotation axis extending along a third direction D3. The third direction D3 is along the left-right direction. On the other hand, the claw portion 61*a* has a protruding portion that protrudes downward. The claw portion 61*a* is positioned at the other end portion of the hook member 61. As a result, the claw portion 61*a* is pivotable about the rotation pin portion 61*b*.

The elastic member 62 acts on the hook member 61 such that the claw portion 61*a* is positioned at a predetermined position with respect to the rear face 21B. The elastic member 62 is, for example, a coil spring. One end portion of the coil spring is attached to the hook member 61 and the other end portion of the coil spring is attached to the rear face 21B.

Figure 8:
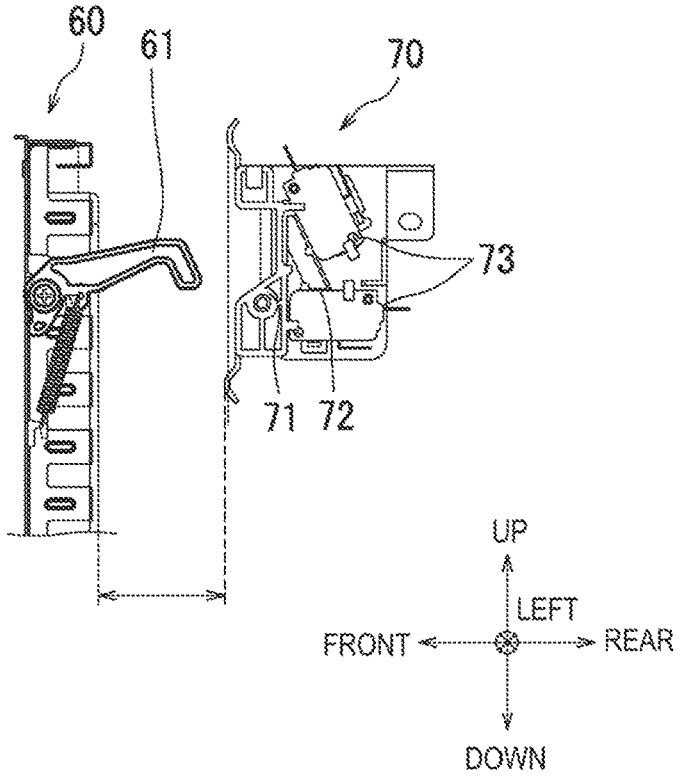
FIGS. 8(*a*) and (*b*) are cross-sectional views illustrating a connecting member and a member to be connected according to the present embodiment.
Figure 8:
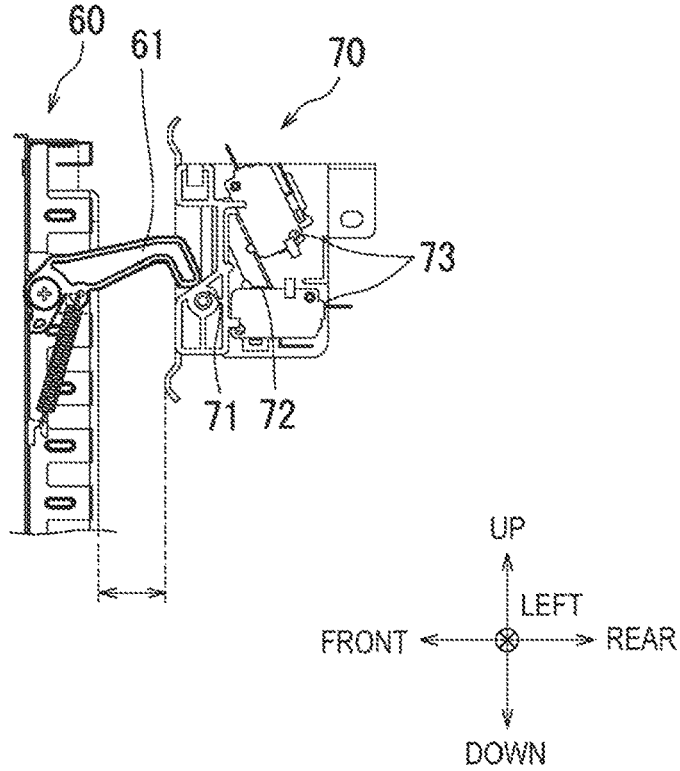
Figure 10:
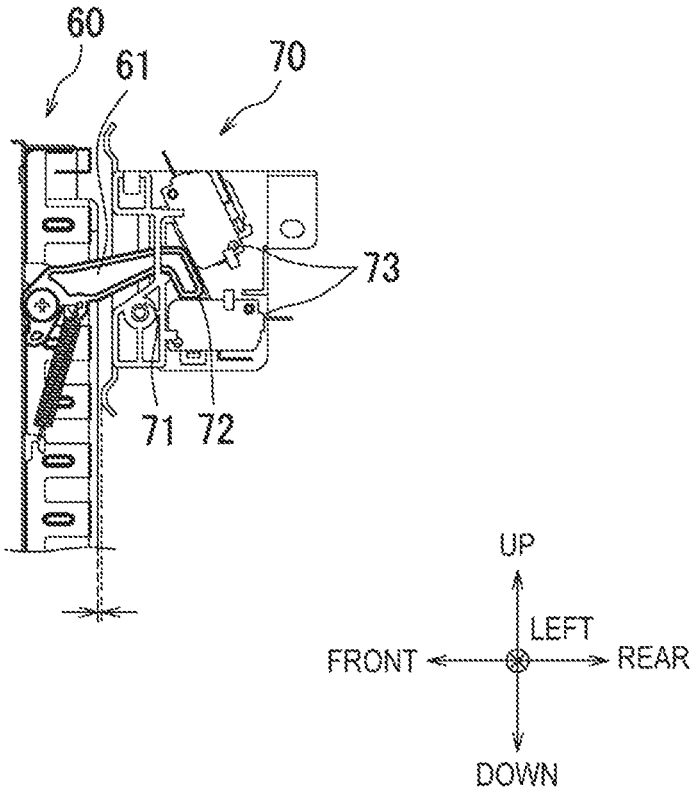
FIG. 10 is a cross-sectional view illustrating the connecting member and the member to be connected according to the present embodiment.

Next, a member to be connected 70 to which the connecting member 60 is connected will be described in detail. FIG. 8(*a*) to FIG. 10 are perspective views illustrating the appearance of the connecting member 60 and the member to be connected 70 according to the present embodiment. As illustrated in FIG. 8(*a*) to FIG. 10, the heating chamber 1 further includes members to be connected 70.

The number of the members to be connected 70 is the same as the number of the connecting members 60. The member to be connected 70 includes, for example, a first member to be connected and a second member to be connected.

The first member to be connected and the second member to be connected are attached to the heating chamber 1. The first member to be connected is attached at the edge portion at the right side of the panel 50 of the heating chamber 1 and at the upper side of the placement portion 22. Specifically, the first member to be connected is attached to the fifth through hole 55. Furthermore, the second member to be connected is attached at the edge portion at the left side of the panel 50 of the heating chamber 1 and at the upper side of the placement portion 22. Specifically, the second member to be connected is attached to the fourth through hole 54.

Specifically, the member to be connected 70 includes an inclined face portion 71, a hole 72, and two sensors 73. The inclined face portion 71 has an inclined surface that gradually increases from a predetermined height. The hole 72 is positioned at a predetermined height and is positioned at the rear side of the inclined face portion 71. A shape of the hole 72 corresponds to a shape of the claw portion 61*a*. The two sensors 73 output a signal to the control unit 5 when the claw portion 61*a* is positioned in the hole 72. On the other hand, when the claw portion 61*a* is not positioned in the hole 72, the two sensors 73 do not output a signal to the control unit 5.

Here, a connection method for connecting the heating chamber 1 and the lid portion 21 will be described in detail. First, as illustrated in FIG. 8(*a*), the drive motor 41 is driven to move the lid portion 21 from the open position to the closed position. In other words, a distance between the panel 50 and the rear face 21B decreases.

Next, when the distance between the panel 50 and the rear face 21B decreases, as illustrated in FIG. 8(*b*), the claw portion 61*a* comes into contact with the inclined face portion 71 of the member to be connected 70.

Figure 9:
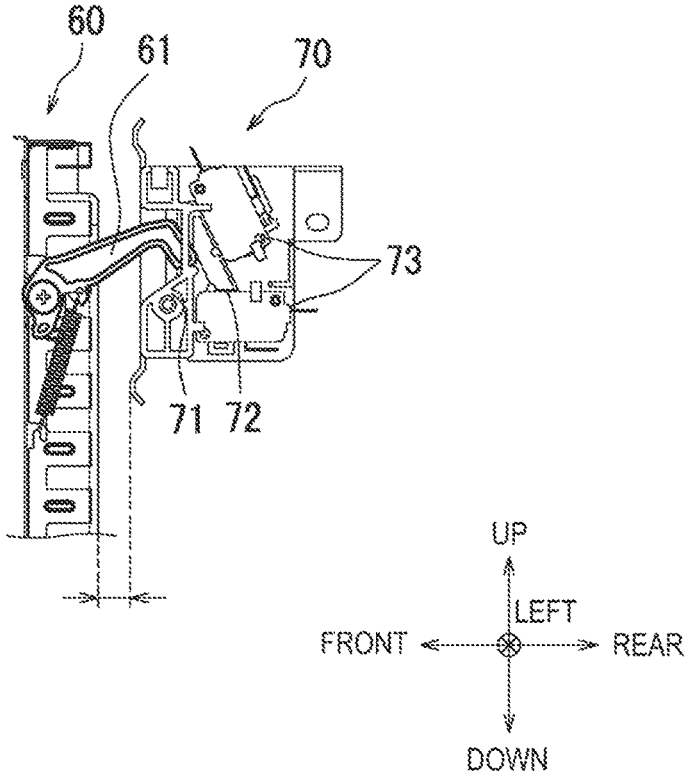
FIGS. 9(*a*) and (*b*) are cross-sectional views illustrating the connecting member and the member to be connected according to the present embodiment.
Figure 9:
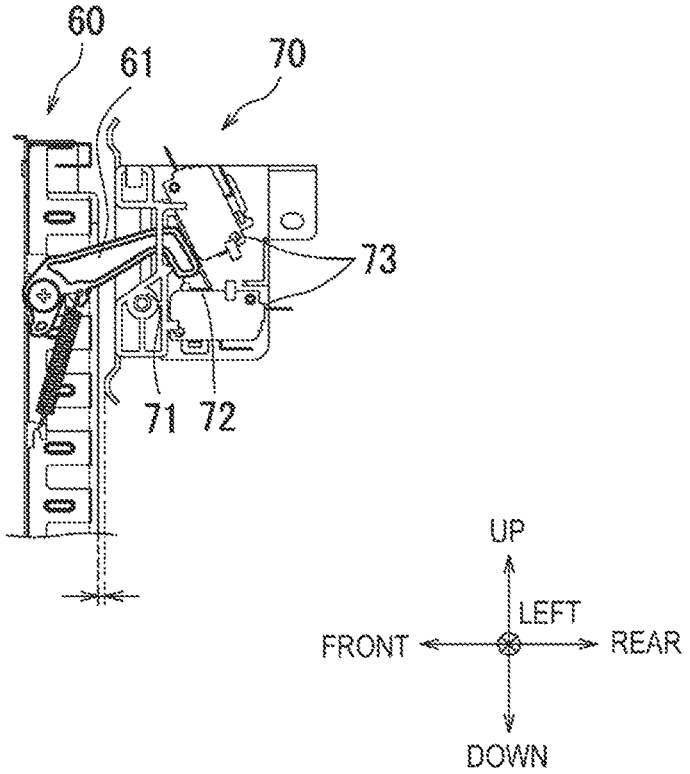

Next, when the distance between the panel 50 and the rear face 21B becomes further smaller, the claw portion 61*a* comes into contact with the inclined face portion 71 of the member to be connected 70, so that as illustrated in FIG. 9(*a*), the claw portion 61*a* is pushed up from a predetermined position against the action of the elastic member 62.

Next, when the distance between the panel 50 and the rear face 21B becomes even smaller, as illustrated in FIG. 9(*b*), the claw portion 61*a* is pulled down to a predetermined position by the action of the elastic member 62.

As a result, as illustrated in FIG. 10, the claw portion 61*a* is positioned in the hole 72. The distance between the panel 50 and the rear face 21B is a predetermined distance. Furthermore, the two sensors 73 output a signal to the control unit 5 when the claw portion 61*a* is positioned in the hole 72.

As described above, the distance between the rear face 21B at the rear side of the lid portion 21 and the panel 50 at the front side of the heating chamber 1 can be held such that the distance between the rear face 21B at the rear side of the lid portion 21 and the panel 50 at the front side of the heating chamber 1 is set to a predetermined distance. As a result, it is possible to suppress the leakage of microwaves from the inside of the heating cooking chamber 100A. Note that when the closed position indicates a position where the panel 50 and the rear face 21B come into contact with each other, the distance between the rear face 21B at the rear side of the lid portion 21 and the panel 50 at the front side of the heating chamber 1 can be held such that the rear face 21B at the rear side of the lid portion 21 and the panel 50 at the front side of the heating chamber 1 come into close contact with each other.

Further, the rotation axis portion 33 is positioned between the first connecting member and the second connecting member. When the degree of parallelism between the rear face 21B at the rear side of the lid portion 21 and the panel 50 at the front side of the heating chamber 1 is retained, the connecting member 60 and the member to be connected 70 are connected at the same time.

On the other hand, the degree of parallelism between the rear face 21B at the rear side of the lid portion 21 and the panel 50 at the front side of the heating chamber 1 may be lost. For example, the distance between the rear face 21B where the first connecting member is positioned and the panel 50 may be shorter than the distance between the rear face 21B where the second connecting member is positioned and the panel 50. Note that the connecting member positioned at the side where the distance between the rear face 21B and the panel 50 is short is referred to as the "first connecting member", and the connecting member positioned at the side where the distance between the rear face 21B and the panel 50 is long is referred to as the "second connecting member". When the degree of parallelism between the rear face 21B at the rear side of the lid portion 21 and the panel 50 at the front side of the heating chamber 1 is lost, the connecting member 60 and the member to be connected 70 are not connected at the same time.

Specifically, when the lid portion 21 is moved to the closed position, the first connecting member of the at least two connecting members 60 connects the heating chamber 1 and the lid portion 21. Thereafter, the second connecting member of the at least two connecting members connects the heating chamber 1 and the lid portion 21. When the second connecting member connects the heating chamber 1 and the lid portion 21, the lid portion 21 pivots about the rotation axis.

As a result, when the degree of parallelism between the rear face 21B at the rear side of the lid portion 21 and the panel 50 at the front side of the heating chamber 1 is lost, the lid portion 21 pivots about the rotation axis, so it is possible to accurately retain the degree of parallelism between the rear face 21B at the rear side of the lid portion 21 and the panel 50 at the front side of the heating chamber 1.

Figure 11:
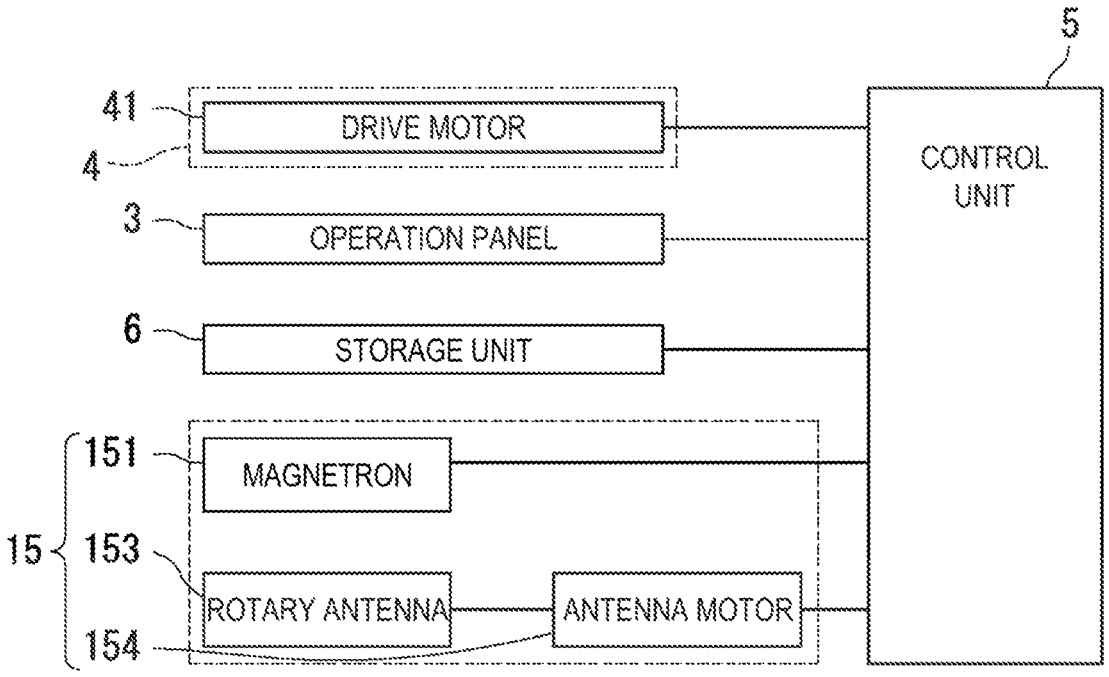
FIG. 11 is a block diagram illustrating a configuration of the drawer type heating cooking apparatus according to the present embodiment.

The configuration of the drawer type heating cooking apparatus 100 will be described in detail with reference to FIG. 11. FIG. 11 is a block diagram illustrating the configuration of the drawer type heating cooking apparatus 100 according to the present embodiment.

As illustrated in FIG. 11, the control unit 5 controls the magnetron 151, the antenna motor 154, the drive motor 41, the operation panel 3, and the storage unit 6 by executing the control programs stored in the storage unit 6.

The control unit 5 controls driving of the microwave supply unit 15. Specifically, the control unit 5 drives the magnetron 151 and the antenna motor 154 after receiving a signal from the two sensors 73.

Figure 12:
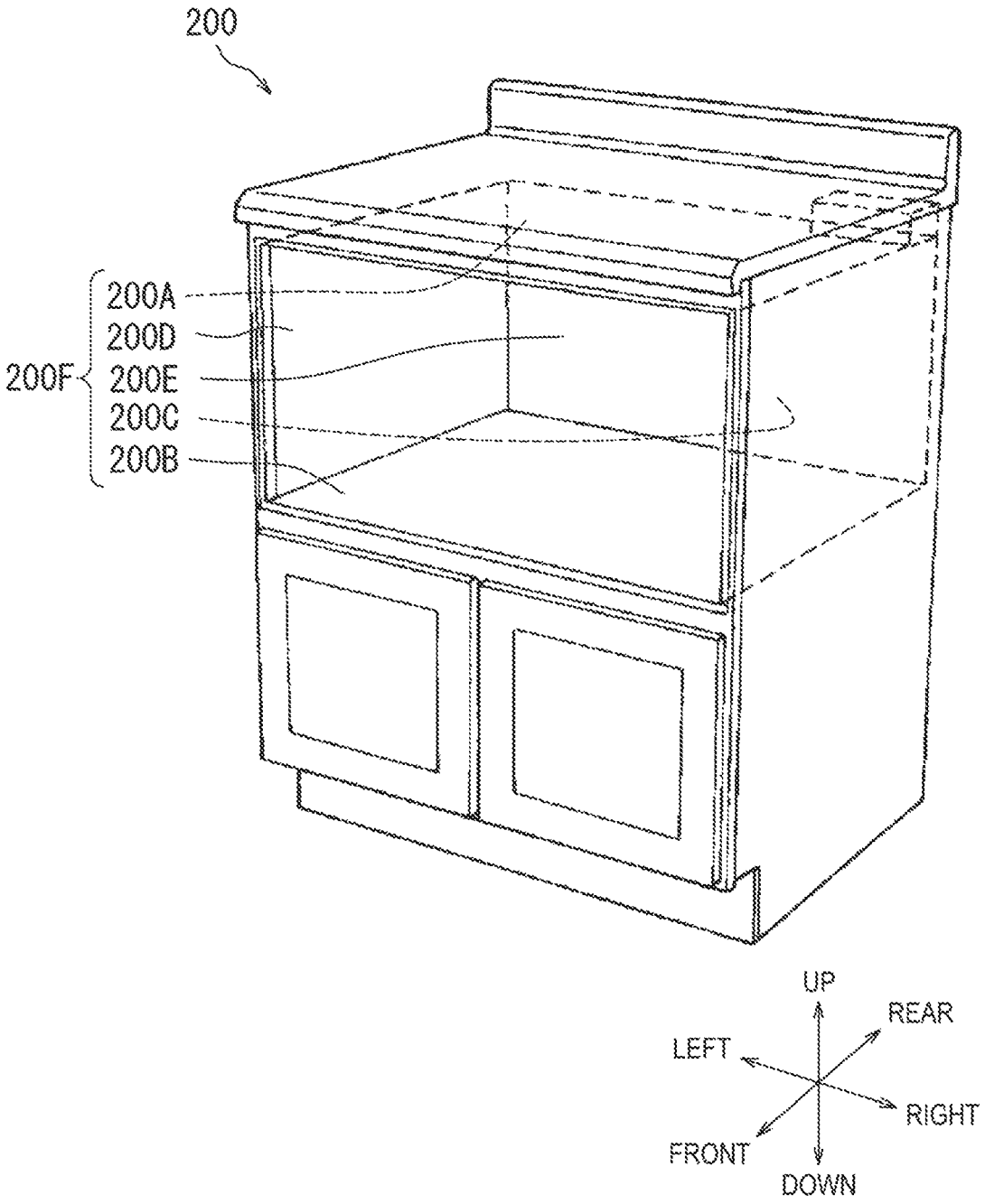
FIG. 12 is a perspective view illustrating an appearance of a cabinet to which the drawer type heating cooking apparatus according to the present embodiment is attached.

Next, a cabinet 200 to which the drawer type heating cooking apparatus 100 is attached will be described with reference to FIG. 12. FIG. 12 is a diagram illustrating an appearance of the cabinet 200 to which the drawer type heating cooking apparatus 100 according to the present embodiment is attached.

The drawer type heating cooking apparatus 100 is installed in the cabinet 200 in a built-in manner. As illustrated in FIG. 10, the cabinet 200 includes an upper wall 200A, a lower wall 200B, a right wall 200C, a left wall 200D, and a rear wall 200E. The upper wall 200A, the lower wall 200B, the right wall 200C, the left wall 200D, and the rear wall 200E form an accommodation portion 200F. The accommodation portion 200F is a rectangular parallelepiped space into which the drawer type heating cooking apparatus 100 is fitted.

An embodiment of the present invention has been described above with reference to the drawings. However, the present invention is not limited to the embodiments described above, and can be implemented in various modes without departing from the gist of the disclosure. Primarily, the drawings schematically illustrate each of the constituent elements for the sake of easier understanding, and the thickness, length, quantity, and the like of each of the illustrated constituent elements are different from the actual thickness, length, quantity, and the like by reason of creation of the drawings. The material, shape, dimensions, and the like of each of the constituent elements illustrated in the embodiment described above are merely exemplary and are not particularly limiting, and various modifications can be made within a scope not departing in essence from the effects of the present invention.

(1) As described with reference to FIG. 1 to FIG. 12, the drawer type heating cooking apparatus 100 includes the microwave supply unit 15, but the present invention is not limited thereto. For example, the drawer type heating cooking apparatus 100 may further include an air supply unit that supplies hot air to the inside of the heating cooking chamber 100A.

(2) The drawer type heating cooking apparatus 100 may further include a grill heater.

(3) the drawer type heating cooking apparatus 100 may include a mesh-like rack. The mesh-like rack is placed on the placement portion 22 of the drawer body 2.

INDUSTRIAL APPLICABILITY

The present invention is useful in the field of a heating cooking apparatus, for example.

REFERENCE SIGNS LIST

1 Heating chamber
2 Drawer body
4 Drive mechanism
21 Lid portion
21A Front face
21B Rear face
25 Support member
26 Fixing member
30 Pivoting mechanism
31 First elastic body
32 Second elastic body
33 Rotation axis portion
41 Drive motor
50 Panel
60 Connecting member
62 Elastic member
100 Drawer type heating cooking apparatus
100B Opening

The invention claimed is:

1. A heating cooking apparatus comprising:

a housing including an opening and a first face disposed on an outer periphery of the opening;

a lid portion including a second face facing the first face, and a fixing member fixed to the second face;

a moving member configured to move along a first direction with respect to the housing;

at least two connecting members configured to connect the housing and the lid portion when the lid portion is placed at a position where the lid portion covers the opening; and a pivoting mechanism configured to couple the fixing member of the lid portion and the moving member such that an entirety of the lid portion pivots about a rotation axis extending along a second direction that is perpendicular to the first direction and to a top surface of the housing; wherein, when a first connecting member of the at least two connecting members connects the housing and the lid portion, and then, a second connecting member of the at least two connecting members connects the housing and the lid portion, the lid portion pivots about the rotation axis;

wherein the pivoting mechanism includes a rotation axis portion extending along the second direction, the first connecting member and the second connecting member are attached to the lid portion, and the rotation axis portion is positioned between the first connecting member and the second connecting member when the rotation axis portion is viewed from the second direction;

and wherein the pivoting mechanism further includes:

a first elastic body configured to act along the first direction between the second face and the moving member, and a second elastic body configured to act along the first direction between the second face and the moving member, and the rotation axis portion is positioned between the first elastic body and the second elastic body when the rotating axis portion is viewed from the second direction.

2. The heating cooking apparatus according to claim 1, further comprising:

a microwave supply unit configured to supply a microwave into a heating cooking chamber communicating with the opening, wherein an interval is provided between the first face and the second face when the lid portion is in a closed configuration.

3. The heating cooking apparatus according to claim 1, wherein each of the at least two connecting members includes a hook member and an elastic member, the hook member includes a rotation pin portion positioned at one end portion and a claw portion positioned at another end portion, and the elastic member acts on the hook member such that the claw portion is placed at a predetermined position with respect to the second face.

4. The heating cooking apparatus according to claim 1, wherein the rotation axis is located at a center portion of the fixing member.

* * * * *